United States Patent [19]

Kadlecik et al.

[11] 3,977,517

[45] Aug. 31, 1976

[54] CONTACT LENS CARRYING CASE

[75] Inventors: John Kadlecik, Macedon; Wayne R. Manning, Victor; John R. Williams, III, Rochester, all of N.Y.

[73] Assignee: Bausch & Lomb Incorporated, Rochester, N.Y.

[22] Filed: June 30, 1975

[21] Appl. No.: 590,222

Related U.S. Application Data

[63] Continuation of Ser. No. 490,535, July 22, 1974, abandoned.

[52] U.S. Cl. ..... 206/5.1; 206/205

[51] Int. Cl.[2] ..... A45C 11/04; B08B 11/02

[58] Field of Search ..... 206/501, 205, 334, 54; 134/137, 143, 166 R

[56] References Cited

UNITED STATES PATENTS

| | | | |
|---|---|---|---|
| 3,444,868 | 5/1969 | Hungerford et al. | 206/5.1 X |
| 3,695,280 | 10/1972 | Sturgeon | 206/5.1 X |
| 3,768,633 | 10/1973 | Nathan | 206/5.1 |
| 3,770,113 | 11/1973 | Thomas | 206/5.1 |

*Primary Examiner*—Steven E. Lipman
*Attorney, Agent, or Firm*—Frank C. Parker; DeWitt M. Morgan

[57] ABSTRACT

A carrying case includes first and second contact lens liquid storage chambers which are located on separate axes and have openings which are inverted one from the other. Each respective storage chamber has a plurality of threads for engagement with a compatible set of threads on each removable cap said caps being provided with a seal to promote integrity between the mating parts. Each cap has a convex base for receiving the concave surface of a contact lens and a concave cover pivotally supported to open and close immediately over the convex base to encapsulate the contact lens in the area defined between the convex base and the concave cover.

14 Claims, 5 Drawing Figures

CONTACT LENS CARRYING CASE

CROSS-REFERENCES TO RELATED APPLICATIONS

This application is a continuation of application Ser. No. 490,535, filed July 22, 1974 now abandoned.

This application is cross-referenced to simultaneously filed and copending design applications, U.S. Ser. No. 490,537 for inventor Paul A. Hoogesteger, and U.S. Ser. No. 490,536 for inventors Paul A. Hoogesteger and John Kadlecik, now U.S. Pat. No. D.237,416, respectively.

This application is cross-referenced to U.S. application Ser. No. 590,223 of Wayne R. Manning.

BACKGROUND OF THE INVENTION

This invention relates to a container for storing, asepticizing and transporting a pair of contact lenses, which may be of either a hard or soft composition. It is well known that hard contact lenses have been used by the industry for years. In recent years, however, a relatively new contact lens has been introduced to the market that is produced from a soft, pliable material which is hydrophilic in nature. It will be appreciated that proper care of the contact lenses is necessary to preclude any contamination which may be caused by any foreign substances that may be absorbed into or carried by the lens. Accordingly, as is well known, it is imperative that the user of the soft contact lenses be provided with the very best means available with which to rid the lens of any contaminants that may exist and to, also, put any bacteria which may be present on, or in, the soft plastic contact lens themselves into a dormant and unharmful state.

Therefore, it is generally recommended that a complete and effective cleansing of the soft plastic contact lenses must be carried out on a regular basis. One general way to asepticize the soft plastic contact lenses, is to place them in a first closure which contains a certain amount of a saline solution that is compatible with the fluid constituents found in the human eye. The container is then placed in a second vessel of water which is brought to the boiling point so that the soft contact lenses inside the first vessel are properly asepticized. As will be appreciated, asepticizing can be accomplished by wet heat methods, such as the one hereinbefore described, and by dry heat methods which are generally well known in the art. Additionally, chemical agents are also available to asepticize such contact lenses with or without the application of heat.

It is well known that there are many different types of contact lens containers available in the marketplace which are intended for use in storing, carrying and, in the case of soft contact lenses, asepticizing the lenses. However, these containers are generally rather large and bulky which causes an inconvenience in the storing and transporting of the lenses. Also, the soft contact lens carrying cases of the past were generally complicated in construction and/or insufficient to perform satisfactorily while the contact lenses were being handled and asepticized.

SUMMARY OF THE INVENTION

This invention provides a compact container for storing, transporting and asepticizing a pair of contact lenses which is simple and inexpensive to manufacture, easy to use and, most importantly, very effective for handling and asepticizing the lenses contained therein. While it is intended that the contact lens container described herein be used for soft contact lenses, it will also work equally as well for contact lenses of the hard variety.

The contact lens case described and claimed in this application is comprised of three main parts, which are: the main storage unit having therein a pair of liquid storage cavities, a pair of removable closure caps which have domed portions formed thereon, and concave members pivotally engaged to the removable closure caps designed to open and close in an area immediately over the domed portions.

The main storage unit may include a pair of cavities for containing a liquid, each of which is positioned 180°, or on opposite sides, from the other. It will be appreciated that any number of cavities may be included and the number is limited only by the convenience of the final design. Also, the cavities are located on separate axes from one another. The wall which forms each respective liquid storage cavity may have only one thread or preferably a series of multi-start external (male) threads formed thereon to accept a complementing series of multi-start internal (female) threads disposed on the removable closure cap. A multi-start feature allows the closure cap to be easily engaged, or disengaged, with the liquid storage cavity. Each removable closure cap may be engaged with the liquid storage cavity, for instance, as in the preferred embodiment, in any of four positions and thereafter securely tightened with only one-quarter of a revolution. This feature makes the mating of the two parts extremely convenient for the user to accomplish. This feature also eliminates the possibility of the user stripping the threads of either, or both, the mating parts.

A resilient sealing device is located on an interior surface of the closure cap which faces the liquid storage chamber. The sealing device is preferably a resilient ring and provides a fluid tight seal between the cap and the cavity when the closure cap is fully engaged with the liquid storage cavity.

The closure cap also has a dome-like portion on the interior surface thereof which is shaped so as to accept and secure the concave surface of a contact lens.

An annular ring surrounds the periphery of the base of the domed portion and has a concave cover pivotally secured thereto. This concave cover is formed by radially extending finger-like protrusions which, when the cover is in the closed position, are substantially above the dome-like portion. The curvature of the concave cover generally matches the curvature of the dome-like portion. The spaces found between the radially extending finger-like protrusions allow substantially free passage of the wetting agent or saline solution. Therefore, the bulk of the wetting solution makes excellent contact with the lens and particularly the convex side of the contact lens. The concave cover has a catch formed thereon directly opposite the hinge or pivot of the cover. A complementing receptacle for the catch is formed in the annular ring. The concave cover may, thus, be opened for introduction of the lens to the dome-like portion and thereafter securely closed. The contact lens is then substantially encapsulated and held in place. The lens cannot slip out of this enclosure as the concave cover and annular ring prevent it from doing so while still providing for the free access of the fluid to the lens.

All of these items, when combined together, provide for a contact lens carrying case that is compact, easy to transport, inexpensive to manufacture, easy to use and most effective for handling and asepticizing of the encapsulated lenses.

DETAILED DESCRIPTION OF THE PREFERRED EMBODIMENT

Figure 1:
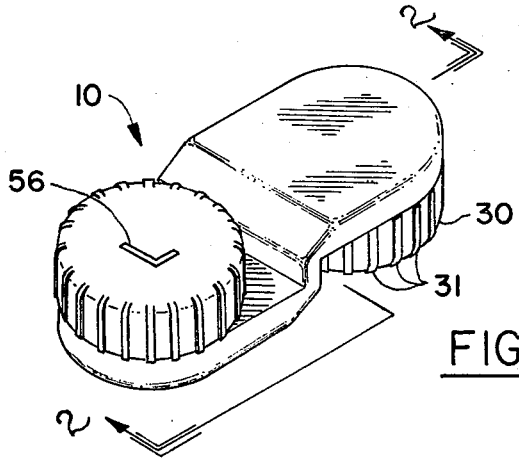
FIG. 1 is a perspective view of the contact lens carrying case according to the principles of this invention.

The contact lens carrying case of the present invention, as illustrated in FIGS. 1 through 5, includes a liquid storage unit 10 having a pair of cavities 12 and 14. The cavities 12 and 14 are longitudinally spaced apart and inverted from each other and are centered about axes A—A′ and B—B′, respectively. The cavities are spaced apart and inverted from each other so that the pair of lenses stored therein will not be intermixed or confused with each other. It is not advisable to have both cavities open at the same time. Therefore, each contact lens can be put in its proper cavity without the fear of mixing them up. It will be appreciated from FIGS. 1 and 2 that structurally either cavity of the carrying case is an exact copy of the other cavity. Thus, for convenience of illustration, by describing one cavity 12, and its associated parts, the other cavity 14 will be understood.

Cavity 12 is defined at the base of liquid storage unit 10 by upstanding annular ring 20. On the external wall 22 of annular ring 20 there is formed a plurality of external threads 24 which are designed to engage a mating set of internal threads 26 which are formed on wall 28 of a removable cap 30. This complementing plurality of threads, exemplified by threads 24, and 26, allow the removable cap 30 to be easily engaged or disengaged, to cover to uncover, respectively, the cavity 12. For instance, by providing four separate thread formations on the cavity ring and the cap, the cap may be mated with the cavity in any four positions. This feature is commonly called "multi-start" threads. Further, the cap 30 may be fully tightened to seal the cavity 12 with only one quarter of one revolution. Similarly, it may be removed by turning it only one quarter of one revolution. This feature provides ultimate simplicity to the user and, further, prevents almost all instances wherein the mating threads could be mismatched, resulting in damaged threads on the cap or the cavity, or both.

Figure 2:
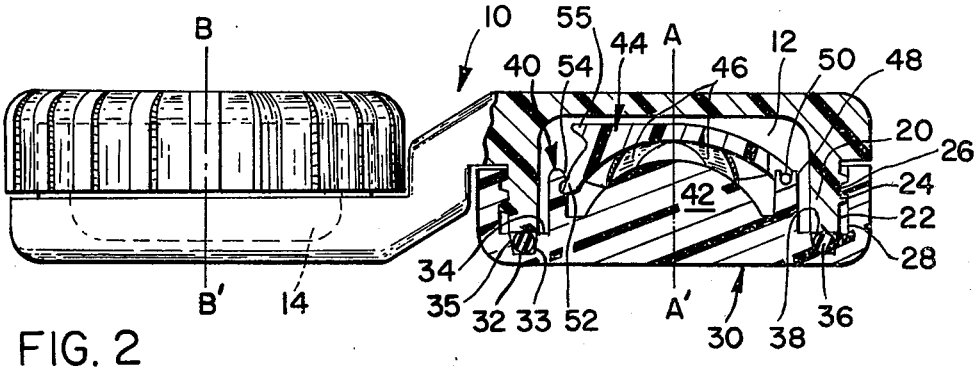
FIG. 2 is a cross-sectional view of the contact lens carrying case taken along line 2—2 of FIG. 1.

Also, to aid in engaging or disengaging the cap 30 from the storage unit 10, there is a plurality of raised ribs 31 formed on the cap's periphery. These raised ribs 31 enable the user to get a good purchase on the cap 30 for ease in engagement or disengagement. Additionally, as seen in FIGS. 1 and 2, the middle portion of the liquid storage unit 10, which extends between the structure defining the cavities 12 and 14, is symmetrically sloped to provide additional finger purchase space for grasping the raised ribs 31 of each of the caps 30 when opening and closing the caps of the case.

A groove 32 is formed below the interior face 34 of the cap 30 slightly inward radially from the internal wall 28. A suitable seal such as an illustrated o-ring 36, formed of a suitable resilient material, such as silicone, is positioned in the groove 32. Other seals or rings of other configurations may be used. The groove 32 is formed so that the inner diameter of the o-ring must be stretched over the inner groove wall 33 and the outer diameter of the o-ring must be compressed to outer groove wall 35. The o-ring 36 is thereby securely held in place and cannot fall out, no matter what position the cap 30 may be in. Additionally, the o-ring 36 remains in place notwithstanding lateral forces imposed thereon when the cap 30 is tightened to seal the cavity. The purpose of the o-ring 36 is to bear against a mating surface 38 of annular ring 20. To guard against undue distortion to the o-ring 36, the interior face 34 of cap 30 bottoms against the mating surface 38 of annular ring 20 after the cap has been engaged to the body by a certain fraction of a revolution. The cavity 12 results when the cap 30 is fully engaged with the storage unit 10. The o-ring 36 is properly compressed by the cap 30 and expands against the walls 33, 35 of the groove 32 so that a fluid tight seal results between the two mating parts.

Figure 3:
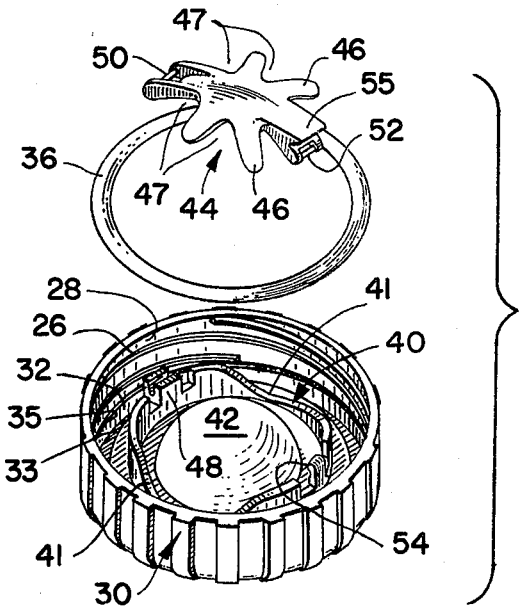
FIG. 3 is an exploded perspective view of the closure cap according to the principles of this invention.

A raised annular ring 40 is formed on the interior surface 34 of the cap 30, just slightly inward from the annular groove 32. Inside the area defined by the raised annular ring 40, there is formed a dome-like section 42 which preferably has a spherical curvature and is designed as a pad to accept the concave side of a contact lens. The raised annular ring 40 may be contoured to have reliefs 41 formed therein to aid the user while inserting or extracting the contact lens to provide finger access to the lens upon the pad. A concave cover member 44 formed of radially extending fingers 46, as best seen in FIG. 3, is pivotally secured to the raised annular ring 40 at pivot 48 by a hinge or pivot pin 50. To prevent shearing or distortion of the pin 50, it is preferred to cam the outside curved surfaces of the supports, between which the pin 50 extends, upon the top surface of the raised annular ring 40 when the cover member 44 is opened and closed. The curved surfaces thusly support the cover member 44 and prevent stress from being placed on the pin 50. The concave cover member has a spherical curvature which complements the dome-like section. The radially extending fingers 46 have openings 47 therebetween, as best seen in FIG. 3, which permits easy access of fluid particularly to the convex side of the contact lens stored on the domed portion 42. The concave cover member 44 also has a catch 52 positioned 180° from the pivot pin 50. The catch 52 cooperates with a detent member 54 provided in the raised annular ring 40 to secure the concave cover member 44 in a closed position. A tang 55 is formed on the concave cover member 44 above the catch 52 to aid the user in opening the concave cover member 44. Of course, it is understood that there is a variety of catches that would work equally as well in this apparatus.

Figure 4:
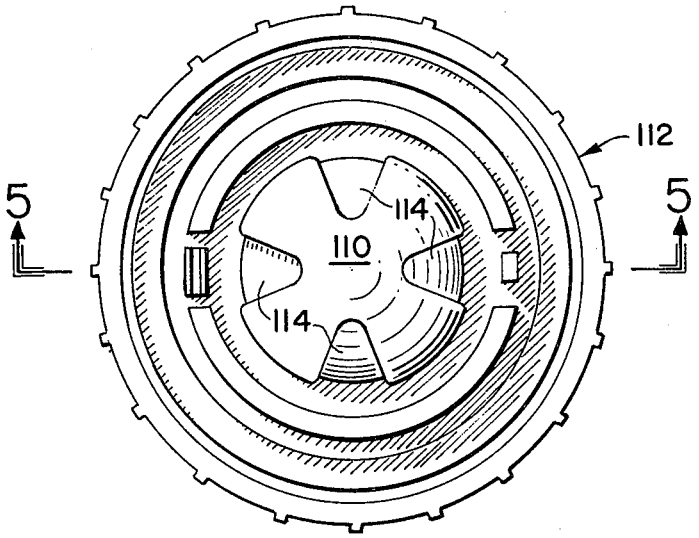
FIG. 4 is a partial plan view of the embodiment of FIG. 3 illustrating an alternate construction mode of the lens carrying pad.
Figure 5:
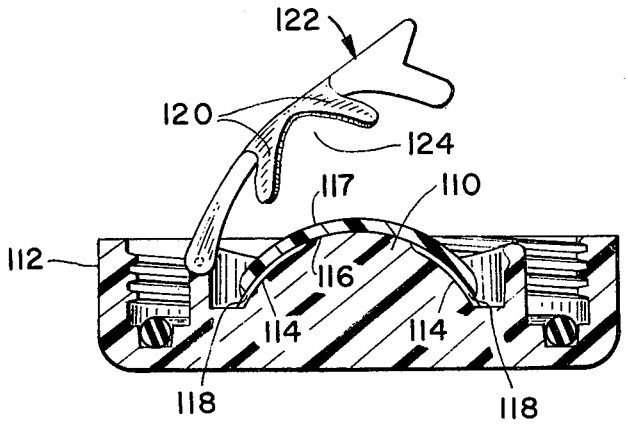
FIG. 5 is a modified cross-sectional view taken along line 5—5 of FIG. 4 and further including the closure cap.

FIGS. 4 and 5 depict in part an alternate embodiment of the present invention. FIG. 4 shows the domed portion 110 of cap 112 having formed therein a plurality of indentations or reliefs 114. The reliefs 114 may be formed in the domed portion to directly expose a greater percentage of the concave surface 116 of a contact lens 117 to fluid in the cavity, as seen in FIG. 5, when the lens is being carried on the domed portion 110. The contained fluid is able to migrate up in the void 118 created by the reliefs, thereby wetting the concave surface, or underside, 116 of the contact lens. It will be appreciated that a greater or even lesser number of reliefs may be provided. The radially extending fingers 120 of the concave cover member 122, shown in the open position in FIG. 5, provide openings 124 therebetween. These openings 124 provide easy access of the fluid to the convex side of the contact lens stored on the domed portion 110. The contact lens 117 would thereby have a great percentage of its total area being contacted by the fluid.

In operation, the user of this device would remove one cap 30 from the storage unit 10 and then introduce a predetermined amount of fluid into the empty cavity 12 of the storage unit. The concave cover member 44 inside the removable cap 30 would then be pivoted to its open position, as best seen in FIG. 5, and the concave surface 116 of a contact lens 117 would be placed on the exposed dome-like section 42. The concave cover member 44 would then be pivoted to its closed position, as best seen in FIG. 2, and secured by catch means 52, 54. The removable cap 30 would then be inverted and properly secured to the now liquid filled cavity. Thereafter the storage unit 10 would be inverted and the above-discussed process repeated for the remaining contact lens.

Certain indentifying indicia, such as indicia 56, as best seen in FIG. 1, can be marked on the removable cap's exterior surface to insure that each contact lens is placed in its own respective cavity.

The foregoing is a description of the principle embodiments of this invention. However, it should be recognized that these are details which may be changed without departing from the spirit or scope of the instant invention.

It is claimed:

1. A case for carrying contact lenses comprising:

a. a body including first and second sides and at least one liquid storage means said sides facing in opposite directions, said liquid storage means having first and second openings, said openings being disposed about separate and spaced apart construction axes, said first opening being disposed on said first side, said second opening being disposed on said second side;

b. first and second cap means, said first cap means cooperating with said first opening and said second cap means cooperating with said second opening to close said liquid storage means; and c. means for holding a pair of contact lenses, said means being supported on one of said liquid storage means and said cap means.

2. The contact lenses carrying case as set forth in claim 1 wherein said liquid storage means comprises first and second separate liquid storage cavities, said first opening providing access to said first cavity, said second opening providing access to said second cavity.

3. The contact lens carrying case as set forth in claim 2, wherein said first and second sides are of stepped configuration.

4. The contact lens carrying case as set forth in claim 3, wherein said body portion includes first and second annular rings, said first annular ring being on said first side, said second annular ring being on said second side, said annular rings defining at least a portion of said liquid storage cavities.

5. The contact lens carrying case as set forth in claim 4, wherein said cap means are received over said annular rings and within the respective steps defined by said first and second sides.

6. The contact lens carrying case as set forth in claim 5, wherein the means for holding each of the pair of contact lenses includes a convex shaped lens support means provided on said one of said liquid storage means and said cap means and a cooperating cover having a concave shaped surface, said cover being pivotally engaged to said one of said liquid storage means and said cap means.

7. A device for carrying contact lenses, comprising:

a. a unit including first and second separate and spaced apart liquid storage means, said first storage means being inverted with respect to said second storage means, said storage means being disposed about separate construction axes;

b. first and second removable caps, said first cap cooperating with said first liquid storage means to form a first closed cavity, said second cap cooperating with said second liquid means to form a second closed cavity, said caps having disposed on an interior surface thereof a convex shaped base for receiving the concave surface of the contact lens; and c. first and second covers each having a concave shaped surface, said first cover being pivotally engaged to said interior surface of said first cap adjacent said corresponding convex shaped base, said second cover being pivotally engaged to said interior surface of said second cap adjacent said corresponding convex shaped base, each of said covers being movable from an open position for placement of a contact lens upon said corresponding convex shaped base to a closed position for retention of said contact lens between said corresponding convex shaped base and said corresponding concave shaped surface.

8. The device for carrying contact lenses as defined in claim 7, further including a raised annular ring disposed about each of said convex shaped bases.

9. The device for carrying contact lenses as described in claim 8, wherein each of said raised annular rings has a top surface contoured to provide easy access to a contact lens retained on said convex shaped base.

10. The device for carrying contact lenses as described in claim 7, wherein said convex shaped bases have reliefs defined therein, said reliefs providing channels for a liquid to directly contact the concave surface of a contact lens.

11. The device for carrying contact lenses as described in claim 7, wherein each of said concave shaped surfaces is defined by radially extending fingers, said fingers having spaces therebetween for a liquid to directly contact the convex surface of a contact lens.

12. The device for carrying contact lenses as described in claim 7, wherein said removable caps and said liquid storage means are provided with a plurality of complementing threads.

13. The device for carrying contact lenses as described in claim 7, further including a pair of seals and wherein each of said caps includes an annular recess for accepting one of said pair of seals.

14. The device for carrying contact lenses as described in claim 11, wherein a stop is provided on each of said removable caps to engage a stop surface defined by each of said liquid storage means thereby preventing said seals from being damaged by preventing overtightening of said caps.

* * * * *

UNITED STATES PATENT OFFICE

CERTIFICATE OF CORRECTION

Patent No. 3,977,517 Dated August 31, 1976

Inventor(s) John Kadlecik, Wayne R. Manning & John R. Williams III

It is certified that error appears in the above-identified patent and that said Letters Patent are hereby corrected as shown below:

Column 3: line 48, change "to cover to uncover" to --to cover or uncover--; and
line 66, change "as seen" to --as best seen--.

Column 5: line 32, change "surface" to --surfaces--.

Column 6: line 24, change "of the contact lens" to --of a contact lens--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*